US011806726B2

(12) United States Patent
Bruhn et al.

(10) Patent No.: US 11,806,726 B2
(45) Date of Patent: Nov. 7, 2023

(54) MAGNETIC SEPARATOR

(71) Applicant: ZERO GRAVITY FILTERS, INC., Brighton, MI (US)

(72) Inventors: James Tolliver Bruhn, Brighton, MI (US); Robert Jay Barden, Manchester, MI (US)

(73) Assignee: ZERO GRAVITY FILTERS, INC., Brighton, MI (US)

( * ) Notice: Subject to any disclaimer, the term of this patent is extended or adjusted under 35 U.S.C. 154(b) by 127 days.

(21) Appl. No.: 17/225,304

(22) Filed: Apr. 8, 2021

(65) Prior Publication Data

US 2022/0323968 A1 Oct. 13, 2022

(51) Int. Cl.
*B03C 1/033* (2006.01)
*B03C 1/28* (2006.01)

(52) U.S. Cl.
CPC ..... *B03C 1/286* (2013.01); *B03C 1/0332* (2013.01); *B03C 2201/18* (2013.01)

(58) Field of Classification Search
None
See application file for complete search history.

(56) References Cited

U.S. PATENT DOCUMENTS 3,143,496 A * 8/1964 Maretzo ..... B03C 1/288 210/791
5,043,063 A 8/1991 Latimer
6,077,333 A 6/2000 Wolfs
7,073,668 B2 7/2006 Alford et al.
2004/0035760 A1 2/2004 Alford et al.
2004/0182769 A1 9/2004 Fogel et al.
2012/0175312 A1 7/2012 Martin et al.
2021/0086193 A1 3/2021 Severin et al.

FOREIGN PATENT DOCUMENTS

CN 208391296 U * 1/2019

OTHER PUBLICATIONS

Guo X—CN-208391296-U machine translation—Jan. 2019 (Year: 2019).*
ASME-Strength-Weld-Tube-to-Tubesheet-Standards—2010 Section VIII (Year: 2010).*
Huffman, B et al—Key Considerations for Tube-End Joint Design—Process Heating, Mar. 2, 2021 (Year: 2021).*
International Search Report and Written Opinion for PCT/US2022/023985 dated Jun. 29, 2022 (14 pages).

* cited by examiner

*Primary Examiner* — Bradley R Spies
(74) *Attorney, Agent, or Firm* — REISING ETHINGTON, P.C.

(57) ABSTRACT

A pneumatically-operated magnetic separator captures magnetic contaminants from process fluids. Process fluids are used in many industrial operations for various purposes. The pneumatically-operated magnetic separator can include a housing wall, a first flange plate assembly, a second flange plate assembly, a main fluid passage, tubes, and shuttles. The first and second flange plate assemblies can each include a pair of flange plates. The tubes extend between the first and second flange plate assemblies, and the shuttles are situated in the tubes. Each of the shuttles includes one or more magnets. During use, the shuttles move longitudinally in the tubes in response to pneumatic actuation and de-actuation, per an example. Weldments attach the tubes and the first and second flange plate assemblies together.

20 Claims, 3 Drawing Sheets

MAGNETIC SEPARATOR

INTRODUCTION

The present disclosure generally relates to separating magnetic contaminants from process fluids in industrial applications and, more particularly, relates to pneumatically-operated magnetic separators employed to separate and remove magnetic contaminants from process fluids.

Process fluids are used in many industrial operations. The fluids include machining coolants, cleaning solutions, degreasing solutions, and quench fluids, among many others. Industries such as the automotive and heavy truck, steel, and industrial HVAC (heating, ventilation, and air conditioning), employ the use of process fluids for machining, honing, grinding, parts washing, induction hardening and quench, paint pre-treatment, steel rolling, as well as many other uses. Metal contaminants are routinely introduced into the process fluids amid working. Magnetic filtration systems can be installed downstream in order to capture and remove the metal contaminants from the process fluids.

SUMMARY

In an embodiment, a pneumatically-operated magnetic separator may include a housing wall, a first flange plate assembly, a second flange plate assembly, a main fluid passage, multiple tubes, multiple shuttles, and multiple weldments. The first flange plate assembly is located near an end of the housing wall. The first flange plate assembly includes a first flange plate and a second flange plate. Multiple first openings are established in the second flange plate. The second flange plate assembly is located near another end of the housing wall. The second flange plate assembly includes a third flange plate and a fourth flange plate. Multiple second opening are established in the fourth flange plate. The main fluid passage is established in part by the housing wall, by the first flange plate assembly, and by the second flange plate assembly. The tubes extend between the first flange plate assembly and the second flange plate assembly. The tubes are received in the first openings and in the second openings. Each of the tubes establishes a bore. The shuttles are situated in the tubes. Each of the shuttles includes one or more magnets. The shuttles can move longitudinally within the bores of the tubes. The first weldments attach the tubes and the first flange plate assembly together. The second weldments attach the tubes and the second flange plate assembly together.

In an embodiment, a pneumatically-operated magnetic separator may include a housing wall, a first flange plate, a second flange plate, a main fluid passage, multiple tubes, multiple shuttles, and multiple first weldments. The first flange plate is located near the housing wall. The first flange plate has multiple first openings. The first openings span wholly through the first flange plate. Each of the first openings has a first open end edge at a first surface of the first flange plate. The second flange plate is located near the housing wall and at a location that is opposite the first flange plate. The main fluid passage is established in part or more by the housing wall. The main fluid passage spans between the first flange plate and the second flange plate. The tubes extend between the first flange plate and the second flange plate. The tubes are inserted in the first openings. Each of the tubes has a tube wall. The tube walls each have a first terminal end edge. The shuttles are situated in the tubes. Each of the shuttles includes one or more magnets. The first weldments attach the first flange plate and the tubes together. The first weldments are established at the first open end edges and at the first terminal end edges.

In an embodiment, a pneumatically-operated magnetic separator may include a housing wall, a first flange plate assembly, a second flange plate assembly, a main fluid passage, multiple tubes, multiple shuttles, multiple first weldments, and multiple second weldments. The first flange plate assembly is located near an end of the housing wall. The first flange plate assembly includes a first flange plate and a second flange plate. Multiple first openings are located in the second flange plate. The first openings span wholly through the second flange plate. Each of the first openings has a first open end edge. The second flange plate assembly is located near another end of the housing wall. The second flange plate assembly includes a third flange plate and a fourth flange plate. Multiple second openings are located in the fourth flange plate. The second openings span wholly through the fourth flange plate. Each of the second openings has a second open end edge. A main fluid passage is established in part by the housing wall, by the first flange plate assembly, and by the second flange plate assembly. The tubes extend between the first flange plate assembly and the second flange plate assembly. The tubes are received in the first openings of the second flange plate, and are received in the second openings of the fourth flange plate. Each of the tubes has a tube wall. The tube walls each have a first terminal end edge and a second terminal end edge. The shuttles are situated in the tubes. Each of the shuttles includes one or more magnets. The first weldments attach the second flange plate and the tubes together. The first weldments are established at the first open end edges and at the first terminal end edges. The first weldments are continuous weldments that extend around the full extents of the first open end edges and of the first terminal end edges. The second weldments attach the fourth flange plate and the tubes together. The second weldments are established at the second open end edges and at the second terminal end edges. The second weldments are continuous weldments that extend around the full extents of the second open end edges and of the second terminal end edges.

BRIEF DESCRIPTION OF THE DRAWINGS

One or more aspects of the disclosure will hereinafter be described in conjunction with the appended drawings, wherein like designations denote like elements, and wherein.

DETAILED DESCRIPTION

Figure 1:
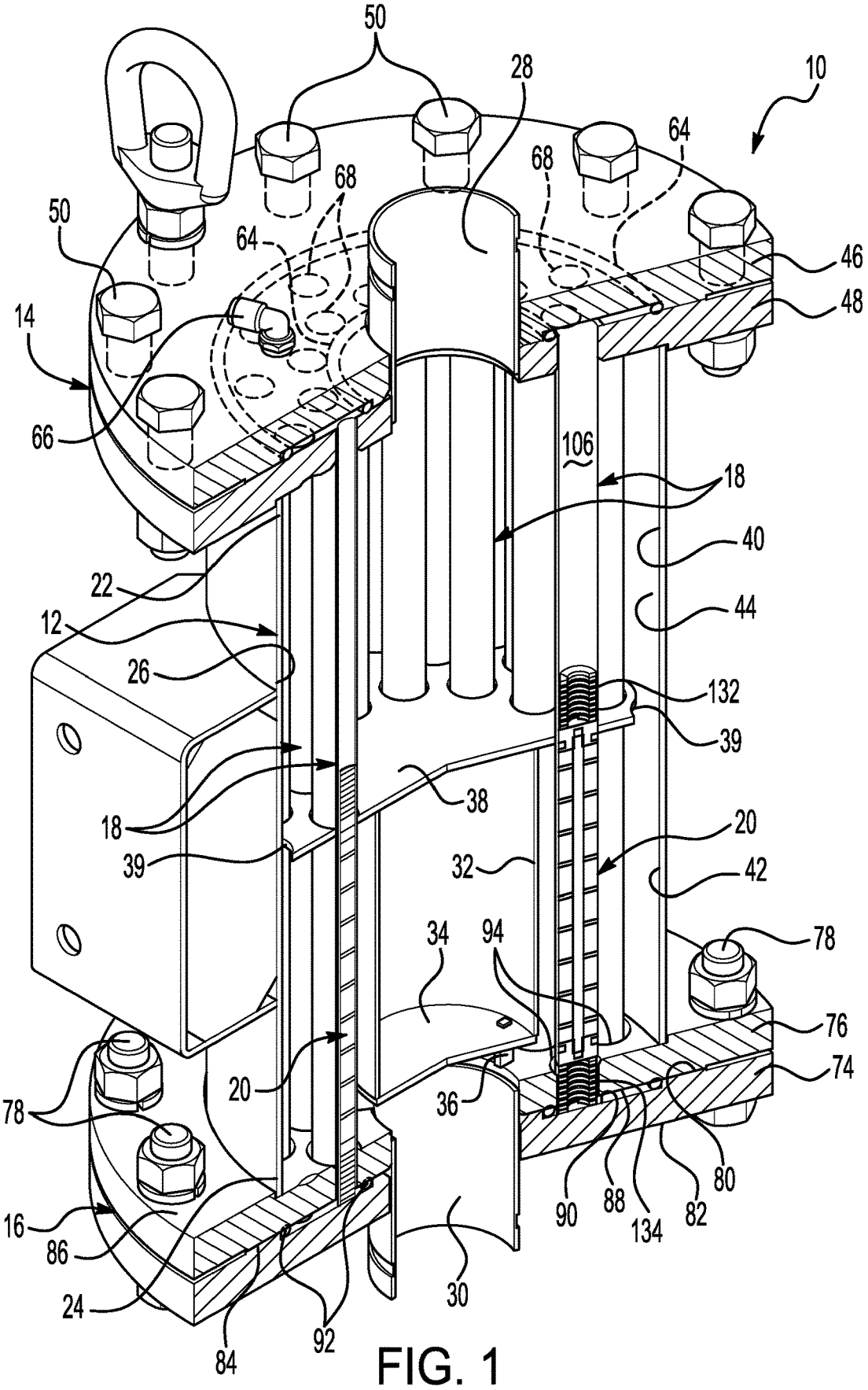
FIG. 1 is a sectional view of an embodiment of a magnetic separator.

With reference to the figures, an embodiment of a pneumatically-operated magnetic separator 10 is presented that separates and removes magnetic contaminants from process fluids. The magnetic separator 10 can be equipped in filtration installations employed for many industries including, but not limited to, automotive and heavy truck, steel, and industrial HVAC (heating, ventilation, and air conditioning). The process fluids themselves can be wide-ranging and can include machining coolants, cleaning solutions, degreasing solutions, and quench fluids. The process fluids are used in applications of all sorts such as machining, honing, grinding, parts washing, induction hardening and quench, paint pretreatment, and steel rolling. Unlike past devices, the magnetic separator 10 has its flange plates and tubes attached together via weldments, and can lack o-ring seals and gaskets therebetween and near the site of attachment. This construction of the magnetic separator 10 furnishes greater robustness and flexibility in the use of the magnetic separator 10. The magnetic separator 10 can be employed in applications of less permanence than larger production facilities, for instance, accommodating use in field applications such as those perhaps most common in the oil and gas industry, environmental remediation, as well as others. Moreover, the magnetic separator 10 can be employed in applications having process fluids that more aggressively deteriorate o-ring seals and gaskets such as those in the oil and gas industry, environmental remediation, as well as others. The magnetic separator 10 hence exhibits a level of mobility in its use not previously demonstrated. Moreover, in embodiments without o-ring seals and gaskets, failure of the seals and gaskets, as may occur under certain circumstances, is altogether circumvented.

Furthermore, unless otherwise specified, the terms radially, axially, and circumferentially, and their grammatical variations refer to directions with respect to the generally circular and cylindrical shape of the magnetic separator 10 and its components as illustrated in the figures.

The magnetic separator 10 is of the in-line type in relation to fluid-flow traveling through it and, depending on its size, can handle fluid flow rates ranging from 1 gallon per minute (GPM) to 250 GPM in certain examples; still, other fluid flow rates may be possible in other examples. The magnetic separator 10 can be part of a larger filtration installation in which multiple individual magnetic separators are arranged in parallel to one another and fed process fluid from a common manifold, for example. The magnetic contaminants captured by the magnetic separator 10 can be particles, fines, or something else—depending on the application and process—and can be composed of a ferrous metal material. Still, the magnetic contaminants subject to removal need not necessarily themselves have magnetic properties and need not have a ferrous metal composition. For example, the magnetic contaminants subject to removal may be initially non-magnetic particles, fines, or something else, and may be subsequently induced to associate with magnetic particles, making them susceptible to a magnetic field. In a water and wastewater treatment example, for instance, certain coagulants such as ferric chloride, ferrous chloride, alum, aluminum sulfate, or other soluble materials may be added to a fluid such as water in order to agglomerate small particles. Calcium in the form of calcium hydroxide or calcium oxide may be employed to enhance the removal of particles, and certain polymeric materials—sometimes referred to as flocculants—may be added to the fluid in order to add strength to an agglomerate of particles or in order to increase its size. Lastly, in this water and wastewater treatment example, a magnetic material such as iron powder, magnate powder, or hematite powder may be added to the fluid in order to furnish the particles with magnetic properties. Yet still, additional examples exist in which initially non-magnetic particles, fines, or something else are made to be susceptible to a magnetic field. The term magnetic contaminants is used expansively herein and is intended to embrace all of these possibilities. Furthermore, the size of the magnetic contaminants subject to capture can vary, and can be 1 micron or larger, or even sub-micron in size. The separation and removal are carried out by the magnetic separator 10 without harm to the process fluid imbued with the magnetic contaminants. The magnetic separator 10 can have varied designs, constructions, and components in different embodiments, dictated at least in part by the particular application and the particular contaminants. In the embodiment of FIGS. 1-4, the magnetic separator 10 is pneumatically operated and actuated and, in general, includes a housing wall 12, a first flange plate assembly 14, a second flange plate assembly 16, multiple tubes 18, and multiple shuttles 20.

With particular reference to FIG. 1, the housing wall 12 makes-up the exterior structure of the magnetic separator 10. The housing wall 12 has a cylindrical shape and is composed of a metal material such as stainless steel. The housing wall 12 extends from a first end 22 at the first flange plate assembly 14, to a second end 24 at the second flange plate assembly 16. A main passage 26 is established at an interior of the housing wall 12; the first and second flange plate assemblies 14, 16 also contribute in the establishment of the main passage 26. Process fluids are fed through the main passage 26 from an inlet conduit 28 and to an outlet conduit 30, or the process fluid flow can be reversed in certain applications and flow in the opposite direction from the conduit denoted with reference number 30 and to the conduit denoted with reference numeral 28. The inlet conduit 28 is disposed in the first flange plate assembly 14 and fluidly communicates with the main passage 26. Similarly, the outlet conduit 30 is disposed in the second flange plate assembly 16 and fluidly communicates with the main passage 26. The inlet and outlet conduits 28, 30 are centered with respect to the main passage 26 and with respect to the first and second flange plate assemblies 14, 16. The main passage 26 spans between the first and second ends 22, 24 and between the first and second flange plate assemblies 14, 16. Process fluids with magnetic contaminants enter the magnetic separator 10 via the inlet conduit 28, and process fluids with less or none of the magnetic contaminants exit the magnetic separator 10 via the outlet conduit 30. A pair of two-way valves or a three-way valve can be equipped downstream of the outlet conduit 30 in order to direct process fluid flow based on the operating mode of the magnetic separator 10.

Furthermore, in the embodiment shown, an internal baffle body 32 is located in the housing wall's interior and within the main passage 26. The internal baffle body 32 serves to divert process fluid flow outwardly toward the tubes 18 and shuttles 20. A more direct and straight fluid flow path between the inlet conduit 28 and outlet conduit 30 is obstructed by the internal baffle body 32. Process fluids and any magnetic contaminants therein are forced to flow in closer proximity to the tubes 18 and shuttles 20, optimizing capture of the magnetic contaminants. In the embodiment depicted, the internal baffle body 32 occupies a lower half of the housing wall's interior. An upper half of the housing wall's interior is free of the internal baffle body 32. The spacing provided at the upper half facilitates extraction of larger obstructions in process fluids that find their way into the magnetic separator 10 during use. Still, in other embodiments, the internal baffle body 32 could occupy both the upper and lower halves of the housing wall's interior. The internal baffle body 32 is a hollow cylinder of metal material with one or more closed ends 34. The internal baffle body 32 is mounted via pegs 36 within the main passage 26. The pegs 36 can be welded to the second flange plate assembly 16. The closed end 34 confronts the outlet conduit 30 across a spacing. Also, in the embodiment shown, an internal baffle plate 38 is located in the housing wall's interior and within the main passage 26. The internal baffle plate 38 serves to support extension of the tubes 18 between the first and second flange plate assemblies 14, 16. The internal baffle plate 38 also divides the main passage 26 into two halves: a first or upper compartment 40 and a second or lower compartment 42. The internal baffle body 32 is located at the lower compartment 42 in this embodiment. The internal baffle plate 38 extends laterally and radially across the main passage 26, and is mounted at its location via welding to the internal baffle body 32. Openings in the internal baffle plate 38 accommodate the passing of the tubes 18 through its structure. To allow process fluid flow to travel from the upper compartment 40 to the lower compartment 42, recesses 39 can reside around a periphery of the internal baffle plate 38. The recesses 39 establish fluid-flow paths between the internal baffle plate 38 and an inside surface 44 of the housing wall 12.

Still referring to FIG. 1, the first flange plate assembly 14 constitutes an upper end of the magnetic separator 10. The first flange plate assembly 14 can have differing designs and constructions and components. In this embodiment, the first flange plate assembly 14 includes a first flange plate 46 and a second flange plate 48. The first and second flange plates 46, 48 are connected to each other via bolts 50. They are both disk-shaped, and can be composed of a metal material such as stainless steel. A somewhat large central opening that resides in both of the first and second flange plates 46, 48 accommodates reception of the inlet conduit 28. Referring now to the enlarged view of FIG. 2, the first flange plate 46 has a first, inboard surface 52 and a second, outboard surface 54. And the second flange plate 48 has a first, inboard surface 56 and a second, outboard surface 58. The first surfaces 52, 56 directly confront each other. To communicate and distribute air pressure to the tubes 18 and shuttles 20 amid use of the magnetic separator 10, a first clearance 60 resides between the first and second flange plates 46, 48 and between the confronting first surfaces 52, 56. The first clearance 60 is established in part by an annular channel 62 defined in the first flange plate 46. The annular channel 62 spans circumferentially around the first flange plate 46 for communication with all of the tubes 18 and shuttles 20; the tubes 18 and shuttles 20 are also positioned circumferentially around the magnetic separator 10. A pair of o-rings 64 of different diameters are seated at an inner circumference and at an outer circumference of the first clearance 60 in order to form seals at their respective locations. The o-rings 64 are sandwiched between the first and second flange plates 46, 48. Further, an air connection 66 is furnished in the first flange plate 46 and communicated with the first clearance 60 for connection with a pneumatic actuation source.

Figure 2:
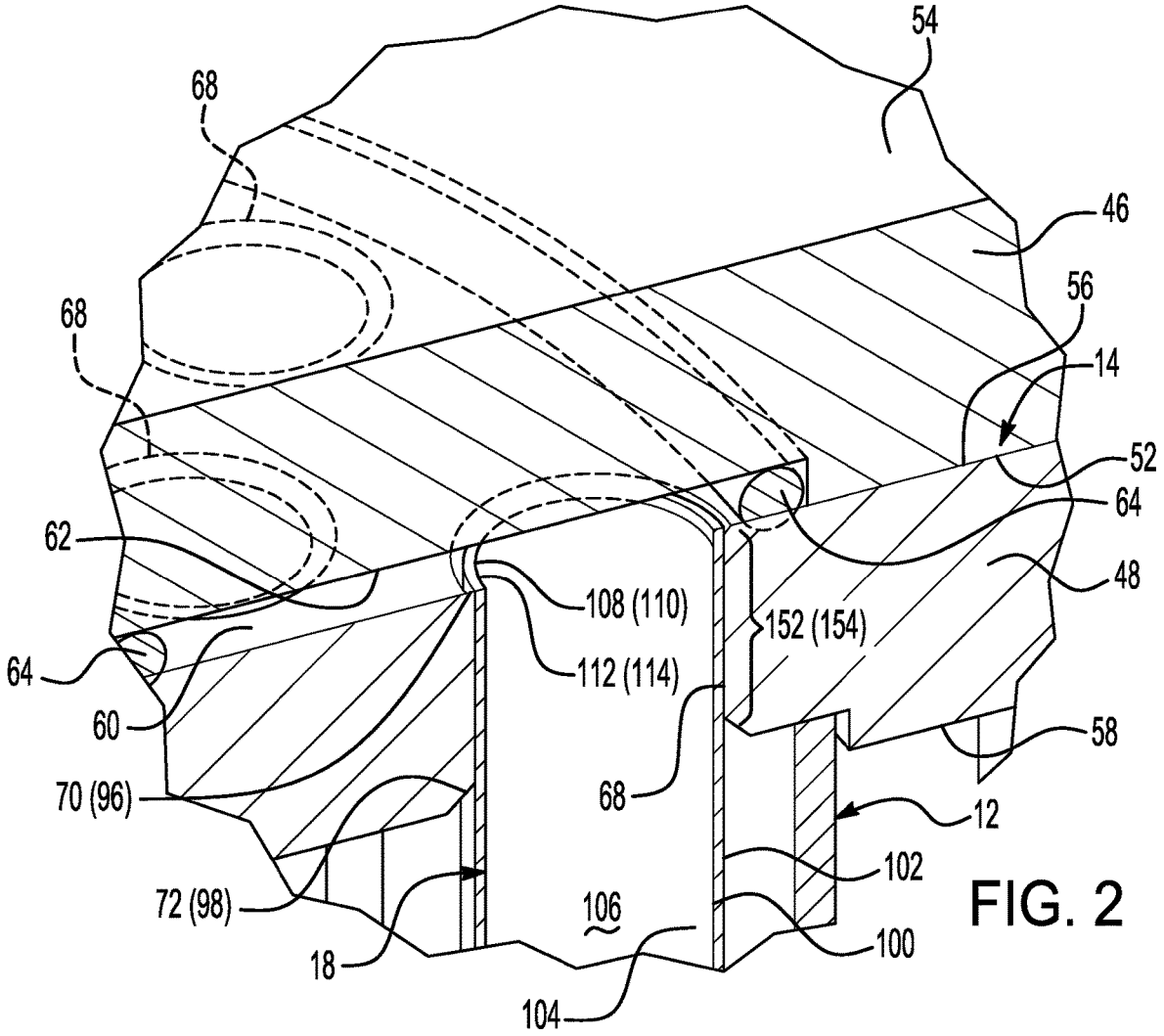
FIG. 2 is an enlarged view of an embodiment of a weldment of the magnetic separator.

With reference to both FIGS. 1 and 2, in order to receive insertion of ends of the tubes 18 amid assembly, the second flange plate 48 has multiple first openings 68 located in its structure. There are as many first openings 68 as there are tubes 18. A single first opening 68 is provided for each tube 18. The first openings 68 have a diameter slightly larger than that of the tubes 18 for a tight fit therebetween upon insertion, as shown best in FIG. 2. Each first opening 68 extends wholly through the second flange plate 48 between the first surface 56 and the second surface 58, and spans between a first open end edge 70 at the first surface 56 and a second open end edge 72 at the second surface 58.

The second flange plate assembly 16 can have a similar design and construction as the first flange assembly 14. Referring to FIG. 1, the second flange plate assembly 16 constitutes a lower end of the magnetic separator 10. In this embodiment, the second flange plate assembly 16 includes a third flange plate 74 and a fourth flange plate 76. The third and fourth flange plates 74, 76 are connected to each other via bolts 78. They are both disk-shaped, and can be composed of a metal material such as stainless steel. A somewhat large central opening that resides in both of the third and fourth flange plates 74, 76 accommodates reception of the outlet conduit 30. The third flange plate 74 has a first, inboard surface 80 and a second, outboard surface 82. And the fourth flange plate 76 has a first, inboard surface 84 and a second, outboard surface 86. The first surfaces 80, 84 directly confront each other. To communicate and distribute air pressure to the tubes 18 and shuttles 20 amid use of the magnetic separator 10, a second clearance 88 resides between the third and fourth flange plates 74, 76 and between the confronting first surfaces 80, 84. The second clearance 88 is established in part by an annular channel 90 defined in the third flange plate 74. The annular channel 90 spans circumferentially around the third flange plate 74 for communication with all of the tubes 18 and shuttles 20. A pair of annular o-rings 92 of different diameters are seated at an inner circumference and at an outer circumference of the second clearance 88 in order to form seals at their respective locations. The o-rings 92 are sandwiched between the third and fourth flange plates 74, 76. Further, an air connection (not shown) can be furnished in the third flange plate 74 and communicated with the second clearance 88 for connection with the pneumatic actuation source.

In order to receive insertion of ends of the tubes 18 amid assembly, the fourth flange plate 76 has multiple second openings 94 located in its structure. There are as many second openings 94 as there are tubes 18. A single second opening 94 is provided for each tube 18. The second openings 94 have a diameter slightly larger than that of the tubes 18 for a tight fit therebetween upon insertion. Each second opening 94 extends wholly through the fourth flange plate 76 between the first surface 84 and the second surface 86, and spans between a first open end edge 96 (represented in FIGS. 2, 2A) at the first surface 84 and a second open end edge 98 (represented in FIG. 2) at the second surface 86.

The tubes 18 are located in the housing wall's interior and within the main passage 26, and extend fully between the first and second flange plate assemblies 14, 16. The tubes 18 extend through the first and second compartments 40, 42 of the main passage 26. At the main passage 26, the tubes 18 have immediate exposure to process fluids flowing through the magnetic separator 10. The process fluids flow around the tubes 18 as it makes its way from the inlet conduit 28 and to the outlet conduit 30. Within the inside of each tube 18, a single shuttle 20 is received. The tubes 18 guide longitudinal and upward and downward movement of the shuttles 20 during use of the magnetic separator 10. Each tube 18 is cylindrical in shape and can be composed of a metal material such as stainless steel. The tubes 18 are arranged circumferentially around the main passage 26 and are offset and spaced from one another, as depicted in FIG. 1. The arrangement can be somewhat uniform in order to balance the magnetic attraction and pull generated by the shuttles' magnets (subsequently introduced) held within the tubes 18. The exact quantity of tubes 18 can vary. In an example, there are a total of twenty-six tubes 18 and twenty-six companion shuttles 20 provided; other quantities are contemplated in other examples. With particular reference to FIG. 2, each tube 18 has a tube wall 100. The tube wall 100 has an outside surface 102 and an inside surface 104. A bore 106 is established at hollow interiors of each tube 18. A first open end 108 is defined at one free end of each tube 18, and likewise a second open end 110 (represented in FIGS. 2, 2A) is defined at the opposite free end of each tube 18. Further, a first terminal end edge 112 is defined at the first open end 108 and, in a similar way, a second terminal end edge 114 (represented in FIGS. 2, 2A) is defined at the second open end 110. The first and second terminal end edges 112, 114 span fully around the respective circumferences of the first and second open ends 108, 110.

Figure 3:
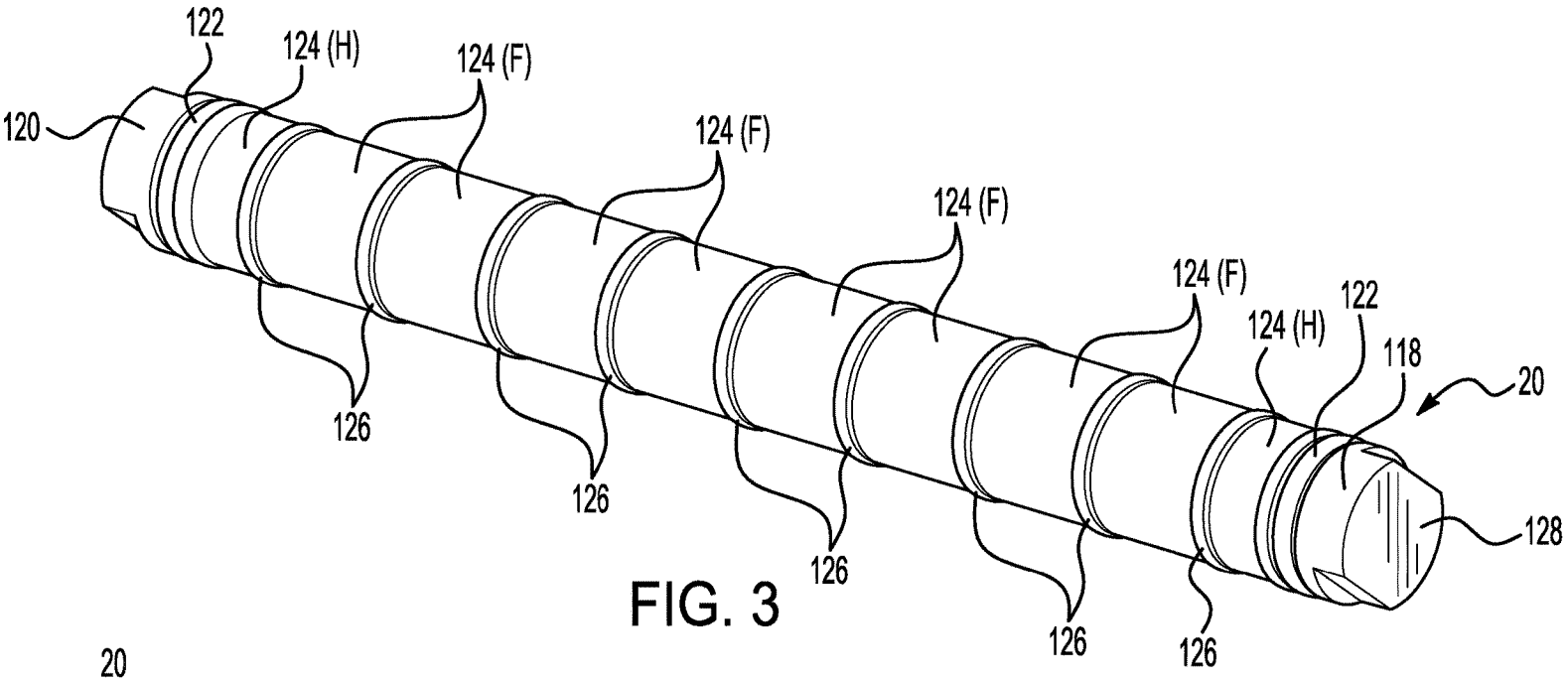
FIG. 3 is a perspective view of a shuttle that can be used with the magnetic separator.
Figure 4:
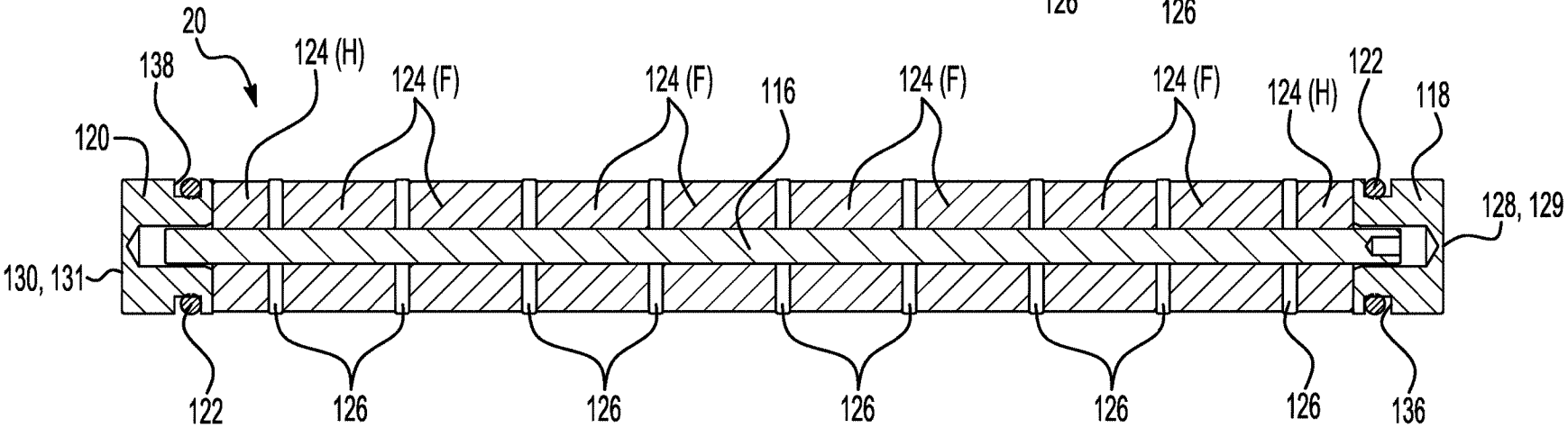
FIG. 4 is a sectional view of the shuttle.

The shuttles 20 are situated within the tubes 18 and serve to attract magnetic contaminants against the tube walls 100 when the shuttles 20 are in position to capture the magnetic contaminants. The magnetic contaminants are retained and build-up against the tube walls 100 due to the attraction. The shuttles 20 are received within the bores 106 of the tubes 18, and can move longitudinally and up and down therein in response to pneumatic actuation. The shuttles 20 are generally cylindrical in shape. A full longitudinal, end-to-end extent of an individual shuttle 20 approximately corresponds to an axial length of the first compartment 40 and to an axial length of the second compartment 42. A diameter of an individual shuttle 20 is slightly less than a diameter of the bores 106 so that the shuttles 20 are able to move therein. The shuttles 20 can have differing designs and constructions and components. Referring to FIGS. 3 and 4, in this embodiment each shuttle 20 includes a spindle 116, a first end cap 118, a second end cap 120, o-rings 122, multiple magnets 124, and multiple pole pieces 126.

The spindle 116 carries the other components of the shuttle 20. The first and second end caps 118, 120 connect to opposite free ends of the spindle 116 and keep the magnets 124 and pole pieces 126 sandwiched together. The connection between the spindle 116 and first and second end caps 118, 120 is via a threading therebetween. The first and second end caps 118, 120 are screwed on respective free ends of the spindle 116. A thread-locking fluid can be applied at the threading. First and second end surfaces 128, 130 of the first and second end caps 118, 120 are planar and receive urging from pressurized air amid use of the magnetic separator 10. The first and second end surfaces 128, 130 establish first and second closed ends 129, 131 thereat of the shuttle 20. In past shuttles, spindles extended through openings in end caps at such surfaces; interior o-rings were provided in the past shuttles between the spindles and end caps because of the openings. In the embodiment of the figures, the spindle 116 does not extend through the first and second end caps 118, 120. Rather, the first and second closed ends 129, 131 at the first and second end surfaces 128, 130 obviate the need for interior o-rings which are hence omitted in the shuttle 20 and in the spindle 116. Potential faults at the interior o-rings are eliminated in the embodiment of the figures.

In assembly, a first spring 132 (FIG. 1) is disposed against the first end cap 118 at the first end surface 128, and similarly a second spring 134 (FIG. 1) is disposed against the second end cap 120 at the second end surface 130. Like the shuttles 20, the first and second springs 132, 134 are received in the bores 106 of the tubes 18. The first and second springs 132, 134 serve to cushion and absorb the impact exerted when the shuttles 20 move longitudinally and up and down in response to pneumatic actuation. The first and second springs 132, 134 can also serve as spacers to locate the shuttles 20 in longitudinal alignment and accordance with the first compartment 40 and with the second compartment 42 in different operating modes of the magnetic separator 10. A longitudinal extent of the first spring 132 can be modestly greater than an axial length of the first opening 68, and likewise a longitudinal extent of the second spring 134 can be modestly greater than an axial length of the second opening 94. With reference again to FIGS. 3 and 4, one o-ring 122 is seated in a groove 136 residing in the first end cap 118, and another o-ring 122 is seated in another groove 138 residing in the second end cap 120. The o-rings 122 form an air-tight seal with the inside surface 104 of the tube wall 100 at their respective locations.

The magnets 124 are carried by the spindle 116 between the first and second end caps 118, 120. The magnets 124 are permanent magnets in this embodiment. They produce a magnetic field that attracts and pulls magnetic contaminants toward and against the tube walls 100. The exact quantity of magnets 124 can vary. In this embodiment, there are a total of eight full magnets (F) and two half magnets (H); other quantities are contemplated in other examples. The magnets 124 are cylindrical in shape with central openings for insertion on the spindle 116. Different materials can be used for the composition of the magnets 124. In an example, the magnets 124 are composed of neodymium-iron-boron (NIB); other materials are contemplated in other examples. Together, the magnets 124 can produce magnetic fields of differing magnitudes, depending on the application. In an example, the magnets 124 produce a magnetic flux density of greater than 10,000 gauss (G); other magnitudes are contemplated in other examples. Lastly, the pole pieces 126 are carried by the spindle 116 and are located in-between the magnets 124. The pole pieces 126 direct the produced magnetic field radially-outboard. The exact quantity of pole pieces 126 can vary and can depend on the quantity and arrangement of the magnets 124. In this embodiment, there are a total of nine pole pieces 126; other quantities are contemplated in other examples. The pole pieces 126 are disk-shaped with central openings for insertion on the spindle 116. Furthermore, in an example, north poles of successively arranged magnets 124 can oppose each other across the interposed pole piece 126; likewise, south poles of successively arranged magnets 124 can oppose each other across the interposed pole piece 126. This arrangement, it has been found, may produce magnetic fields of greater strength.

It has been determined that the interrelationship between the flange plates and tubes should be sealed against air and fluid leakage. In the past, o-ring seals were placed at an interface between the flange plates and tubes—a first o-ring seal for air and a second o-ring seal for process fluids. The first and second o-ring seals were spaced from each other and seated in grooves at the inside of openings in the flange plates. The tubes were then inserted partway into the openings with the tubes' outside surfaces making abutment with the first and second o-ring seals. The tubes were removable from the flange plates for subsequent servicing and replacement of the o-ring seals. Since the two o-ring seals had different sealing purposes—the first for air and the second for process fluids—they were composed of different materials relative to each other. Moreover, the material selected for the second o-ring seal was often dictated by the process fluids subject to separation and removal of contaminants in the associated magnetic separator. One material may be suitable against deterioration for one kind of process fluids, but may not be suitable, and consequently would more rapidly deteriorate, for another kind of process fluids. Over time and with extensive use, it has been discovered in some cases that the o-ring seals fail and need replacement. The failure could be due to deterioration or other causes. Once failure occurred, the past magnetic separators would have to be un-installed and un-assembled, the tubes removed, the o-ring seals removed and replaced, and the parts re-assembled and re-installed. The potential for failure in certain circumstances has been found to inhibit the usefulness of the past magnetic separators, and could thwart their readiness for use in field applications and other more mobile applications, as well as in applications having process fluids of a more aggressive nature in terms of its facility to deteriorate o-ring seals.

In order to resolve some or all of these potential shortcomings, the magnetic separator 10 has weldments established between the tubes 18 and the first and second flange plate assemblies 14, 16. The weldments serve as a somewhat permanent attachment between the tubes 18 and first and second flange plate assemblies 14, 16, and concurrently serve as an enduring seal against both air leakage and process fluids leakage between the tubes 18 and first and second flange plate assemblies 14, 16. Since sealing is furnished by the weldments themselves, the o-ring seals of the past assemblies may be unnecessary and can be sidestepped altogether; still, in some embodiments the o-ring seals could be provided as an auxiliary measure. The weldments provide a seal without deterioration. The magnetic separator 10 hence has enhanced usefulness and is suitable and ready for use in field applications such as in oil and gas, environmental remediation, and others, and has enhanced usefulness in applications employing process fluids of the more aggressive nature. The weldments can take different forms in different embodiments. One challenge encountered when effecting a proper attachment and seal via the weldments, per an embodiment, was the thinness of the tube walls 100. In an example, the tube walls 100 have a thickness (i.e., outside surface 102 to inside surface 104) of approximately 0.07 mills (thousandths of an inch; 0.000778 millimeters (mm)); other values for the thickness are contemplated in other examples. Thinner tube walls 100, it has been found, can more readily be harmed and deformed amid welding, compromising the weld itself and compromising the seal against air and process fluids leakage.

Figure 2A:
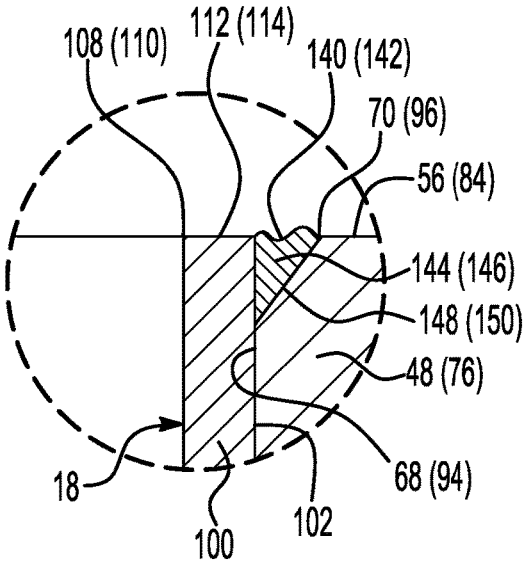
FIG. 2A is another enlarged view of the weldment.

With particular reference now to FIG. 2A, in this embodiment first weldments 140 are established between each of the tubes 18 and the second flange plate 48, and, in a similar way, second weldments 142 (represented in FIG. 2A) are established between each of the tubes 18 and the fourth flange plate 76. In assembly, the tubes 18 are inserted into the first opening 68 for a full insertion therebetween whereby the first terminal end edges 112 reside at the first open end edges 70. The first open ends 108 are generally flush with the first open end edges 70 with respect to the first surface 56 of the second flange plate 48. The first terminal end edges 112 and the first open end edges 70 are in general alignment with a plane defined by the first surface 56. The first weldments 140 are established between the first open ends 108 and the first open end edges 70, and between the first terminal end edges 112 and the first open end edges 70. Further, in an embodiment, the first weldments 140 can be formed between the outside surface 102 and the first surface 56. To provide an attachment and seal that is complete around the tubes 18 and around the first openings 68, the first weldments 140 are continuously formed over full extents of first interfaces between the first open end edges 70 and the first terminal end edges 112. The first weldments 140 extend circumferentially continuously around the tubes 18 and around the first openings 68. In an example, the first weldments 140 are prepared by a tungsten inert gas (TIG) welding process, producing TIG weldments. A first weldment filler material 144 can be supplied in the TIG welding process. Still, other types of welding processes could be utilized to produce the first weldments 140. In order to facilitate welding in certain embodiments, and depending on the particular welding process carried out, first bevel edges 148 can be provided at the first open end edges 70. In the example of TIG welding, the first weldment filler material 144 could then be set in the spacing established at the first bevel edges 148.

Similarly, at the fourth flange plate 76, the tubes 18 are inserted into the second opening 94 for a full insertion therebetween whereby the second terminal end edges 114 reside at the first open end edges 96. The second open ends 110 are generally flush with the first open end edges 96 with respect to the first surface 84 of the fourth flange plate 76. The second terminal end edges 114 and the first open end edges 96 are in general alignment with a plane defined by the first surface 84. The second weldments 142 are established between the second open ends 110 and the first open end edges 96, and between the second terminal end edges 114 and the first open end edges 96. Further, in an embodiment, the second weldments 142 can be formed between the outside surface 102 and the first surface 84. To provide an attachment and seal that is complete around the tubes 18 and around the second openings 94, the second weldments 142 are continuously formed over full extents of second interfaces between the first open end edges 96 and the second terminal end edges 114. The second weldments 142 extend circumferentially continuously around the tubes 18 and around the second openings 94. In an example, the second weldments 142 are prepared by a tungsten inert gas (TIG) welding process, producing TIG weldments. A second weldment filler material 146 can be supplied in the TIG welding process. Still, other types of welding processes could be utilized to produce the second weldments 142. In order to facilitate welding in certain embodiments, and depending on the particular welding process carried out, second bevel edges 150 can be provided at the first open end edges 96. In the example of TIG welding, the second weldment filler material 146 could then be set in the spacing established at the second bevel edges 150.

The sealing provided by the first and second weldments 140, 142 can supplant the o-ring seals of past assemblies. The attendant and unwanted potential for o-ring failure can therefore be averted in certain embodiments. For instance, o-ring seals can be absent adjacent first proximities of attachment between the tubes 18 and the first flange plate assembly 14 and, specifically, the second flange plate 48. More particularly, in the embodiment of the figures o-ring seals are not provided and are absent over first longitudinal extents of reception 152 (FIG. 2) between the tubes 18 and the first openings 68. Likewise, o-ring seals can be absent adjacent second proximities of attachment between the tubes 18 and the second flange plate assembly 16 and, specifically, the fourth flange plate 76. More particularly, in the embodiment of the figures o-ring seals are not provided and are absent over second longitudinal extents of reception 154 (FIG. 2) between the tubes 18 and the second openings 94.

In operation, the magnetic separator 10 and its components work together to separate and remove magnetic contaminants from process fluids. The magnetic separator 10 has at least two operating modes: a filter mode and a purge mode. In the filter mode, the shuttles 20 are positioned in the tubes 18 in alignment with the second compartment 42. This mode and position are demonstrated in FIG. 1. Pneumatic pressure via the air connection 66 moves the shuttles 20 to their positions in the tubes 18 at the second compartment 42. Differential air pressure between the first and second end surfaces 128, 130 of the shuttles 20 effects movement and positioning of the shuttles 20 in the tubes 18. In the filter mode, process fluids enter the main passage 26 by way of the inlet conduit 28 and flow through the second compartment 42. Magnetic contaminants in the process fluids are attracted to the tubes 18 by the shuttles' magnets 124, and are retained against the tube walls 100. The magnetic contaminants are captured, and hence do not exit the main passage 26 through the outlet conduit 30 with the now-cleansed process fluids. In the purge mode, on the other hand, the shuttles 20 are positioned in alignment with the first compartment 40. Pneumatic pressure via the air connection at the second flange plate assembly 16 moves the shuttles 20 to their positions in the tubes 18 at the first compartment 40. In the purge mode, previously-captured magnetic contaminants are released in the second compartment 42 due to the absence of the positioning of the shuttles 20 at the second compartment 42. The main passage 26 is purged and the released magnetic contaminants are flushed and discharged out of the magnetic separator 10. Furthermore, while in the purge mode, magnetic contaminants from newly-entered process fluids can collect at the first compartment 40 so that the magnetic separator 10 operates in an uninterrupted manner in which process fluids are continually fed to it.

It is to be understood that the foregoing is a description of one or more aspects of the disclosure. The disclosure is not limited to the particular embodiment(s) disclosed herein, but rather is defined solely by the claims below. Furthermore, the statements contained in the foregoing description relate to particular embodiments and are not to be construed as limitations on the scope of the disclosure or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A pneumatically-operated magnetic separator, comprising:

a housing wall;

a first flange plate assembly located adjacent an end of said housing wall, said first flange plate assembly including a first flange plate and a second flange plate, a plurality of first openings located in said second flange plate;

a second flange plate assembly located adjacent another end of said housing wall, said second flange plate assembly including a third flange plate and a fourth flange plate, a plurality of second openings located in said fourth flange plate;

a main fluid passage established in part by said housing wall, by said first flange plate assembly, and by said second flange plate assembly;

a plurality of tubes extending between said first flange plate assembly and said second flange plate assembly, said plurality of tubes received in said plurality of first openings of said second flange plate and in said plurality of second openings of said fourth flange plate, each of said plurality of tubes having a bore;

a plurality of shuttles situated in said bores of said plurality of tubes, each of said plurality of shuttles including at least one magnet, said plurality of shuttles longitudinally moveable within said bores;

an internal baffle plate located within said main fluid passage and extending laterally and radially across said main fluid passage, said internal baffle plate dividing said main fluid passage into a first compartment and a second compartment, a plurality of recesses residing around a periphery of said internal baffle plate and establishing fluid-flow paths between said internal baffle plate and said housing wall for process fluid flow from said first compartment and to said second compartment; and a plurality of first weldments attaching said plurality of tubes and said first flange plate assembly together, and a plurality of second weldments attaching said plurality of tubes and said second flange plate assembly together;

wherein said second flange plate has a first surface in confrontation with said first flange plate, each of said plurality of tubes has a first terminal end, and said plurality of first weldments is established at said first surface and said first terminal ends, wherein said fourth flange plate has a second surface in confrontation with said third flange plate, each of said plurality of tubes has a second terminal end, and said plurality of second weldments is established at said second surface and said second terminal ends, wherein said plurality of first weldments are a plurality of first tungsten inert gas (TIG) weldments, wherein said plurality of second weldments are a plurality of second tungsten inert gas (TIG) weldments, wherein a first bevel edge is provided at first open end edges of each of said plurality of first openings, said plurality of first TIG weldments located at said first bevel edges, and wherein a second bevel edge is provided at second open end edges of each of said plurality of second openings, said plurality of second TIG weldments located at said second bevel edges.

2. The pneumatically-operated magnetic separator as set forth in claim 1, wherein a first proximity of attachment between said plurality of tubes and said first flange plate assembly lacks an o-ring seal thereat, and a second proximity of attachment between said plurality of tubes and said second flange plate assembly lacks an o-ring seal thereat.

3. The pneumatically-operated magnetic separator as set forth in claim 1, wherein o-ring seals are absent at a first longitudinal extent of reception between said plurality of tubes and said plurality of first openings, and o-ring seals are absent at a second longitudinal extent of reception between said plurality of tubes and said plurality of second openings.

4. The pneumatically-operated magnetic separator as set forth in claim 1, wherein said plurality of first weldments is established between said plurality of tubes and said second flange plate, and wherein said plurality of second weldments is established between said plurality of tubes and said fourth flange plate.

5. The pneumatically-operated magnetic separator as set forth in claim 1, wherein each of said plurality of tubes has a first terminal end edge, and said plurality of first weldments is established at said first open end edges and said first terminal end edges.

6. The pneumatically-operated magnetic separator as set forth in claim 5, wherein each of said plurality of tubes has a second terminal end edge, and said plurality of second weldments is established at said second open end edges and said second terminal end edges.

7. The pneumatically-operated magnetic separator as set forth in claim 6, wherein each of said plurality of first weldments is a continuous weldment established over a full extent of a first interface between a respective first open end edge and a respective first terminal end edge.

8. The pneumatically-operated magnetic separator as set forth in claim 7, wherein each of said plurality of second weldments is a continuous weldment established over a full extent of a second interface between a respective second open end edge and a respective second terminal end edge.

9. The pneumatically-operated magnetic separator as set forth in claim 1, wherein a first clearance resides between said first flange plate and said second flange plate, a second clearance resides between said third flange plate and said fourth flange plate, said first and second clearances in communication with said bores of said plurality of tubes, said first clearance established by a first annular channel defined in said first flange plate, said second clearance established by a second annular channel defined in said third flange plate, said plurality of first weldments located adjacent said first clearance, and said plurality of second weldments located adjacent said second clearance.

10. The pneumatically-operated magnetic separator as set forth in claim 9, wherein longitudinal movement of said plurality of shuttles within said bores of said plurality of tubes is effected by application and non-application of pressurized gas at said first and second clearances.

11. The pneumatically-operated magnetic separator as set forth in claim 1, wherein each of said plurality of shuttles includes a spindle, a first end cap, and a second end cap, said spindle carrying said at least one magnet, said first end cap connected to said spindle and establishing a first closed end thereat, and said second end cap connected to said spindle and establishing a second closed end thereat.

12. A pneumatically-operated magnetic separator, comprising:

a housing wall;

a first flange plate located adjacent said housing wall, said first flange plate having a plurality of first openings, said plurality of first openings spanning wholly through said first flange plate, each of said plurality of first openings having a first open end edge at a first surface of said first flange plate;

a second flange plate located adjacent said housing wall opposite said first flange plate;

a main fluid passage established at least in part by said housing wall and spanning between said first flange plate and said second flange plate;

a plurality of tubes extending between said first flange plate and said second flange plate, said plurality of tubes inserted in said plurality of first openings, each of said plurality of tubes having a tube wall, said tube walls having a first terminal end edge;

a plurality of shuttles situated in said plurality of tubes, each of said plurality of shuttles including at least one magnet;

an internal baffle plate located within said main fluid passage and extending laterally and radially across said main fluid passage, said internal baffle plate dividing said main fluid passage into a first compartment and a second compartment, a plurality of recesses residing around a periphery of said internal baffle plate and establishing fluid-flow paths between said internal baffle plate and said housing wall for process fluid flow from said first compartment and to said second compartment; and a plurality of first weldments attaching said first flange plate and said plurality of tubes together, said plurality of first weldments established at said first open end edges and at said first terminal end edges, wherein said plurality of first weldments are a plurality of first tungsten inert gas (TIG) weldments;

wherein a first bevel edge is provided at each of said first open end edges, and said plurality of first TIG weldments is located at said first bevel edges.

13. The pneumatically-operated magnetic separator as set forth in claim 12, wherein said second flange plate has a plurality of second openings, said plurality of second openings spanning wholly through said second flange plate, each of said plurality of second openings having a second open end edge at a second surface of said second flange plate, said plurality of tubes inserted in said plurality of second openings, said tube walls having a second terminal end edge, the pneumatically-operated magnetic separator further comprising a plurality of second weldments attaching said second flange plate and said plurality of tubes together, said plurality of second weldments established at said second open end edges and at said second terminal end edges.

14. The pneumatically-operated magnetic separator as set forth in claim 12, wherein said first terminal end edges reside at said first open end edges and are in general alignment with a plane established by said first surface of said first flange plate.

15. The pneumatically-operated magnetic separator as set forth in claim 12, wherein said plurality of first weldments each comprises a weldment filler material.

16. The pneumatically-operated magnetic separator as set forth in claim 12, wherein o-ring seals are absent along a first longitudinal extent of reception between said plurality of tubes and said plurality of first openings.

17. A pneumatically-operated magnetic separator, comprising:

a housing wall;

a first flange plate assembly located adjacent an end of said housing wall, said first flange plate assembly including a first flange plate and a second flange plate, a plurality of first openings located in said second flange plate, said plurality of first openings spanning wholly through said second flange plate, each of said plurality of first openings having a first open end edge, a first bevel edge is provided at each of said first open end edges, a first annular channel defined in said first flange plate;

a second flange plate assembly located adjacent another end of said housing wall, said second flange plate assembly including a third flange plate and a fourth flange plate, a plurality of second openings located in said fourth flange plate, said plurality of second openings spanning wholly through said fourth flange plate, each of said plurality of second openings having a second open end edge, a second bevel edge is provided at each of said second open end edges, a second annular channel defined in said second flange plate;

a main fluid passage established in part by said housing wall, by said first flange plate assembly, and by said second flange plate assembly;

a plurality of tubes extending between said first flange plate assembly and said second flange plate assembly, said plurality of tubes received in said plurality of first openings of said second flange plate and in said plurality of second openings of said fourth flange plate, each of said plurality of tubes having a tube wall, said tube walls having a first terminal end edge and a second terminal end edge;

a plurality of shuttles situated in said plurality of tubes, each of said plurality of shuttles including at least one magnet;

an internal baffle plate located within said main fluid passage and extending laterally and radially across said main fluid passage, said internal baffle plate dividing said main fluid passage into a first compartment and a second compartment, a plurality of recesses residing around a periphery of said internal baffle plate and establishing fluid-flow paths between said internal baffle plate and said housing wall for process fluid flow from said first compartment and to said second compartment;

a plurality of first tungsten inert gas (TIG) weldments attaching said second flange plate and said plurality of tubes together, said plurality of first TIG weldments established at said first open end edges and at said first terminal end edges and located at said first bevel edges, said plurality of first TIG weldments are continuous weldments extending around full extents of said first open end edges and said first terminal end edges, said plurality of first TIG weldments located adjacent said first annular channel; and a plurality of second TIG weldments attaching said fourth flange plate and said plurality of tubes together, said plurality of second TIG weldments established at said second open end edges and at said second terminal end edges and located at said second bevel edges, said plurality of second TIG weldments are continuous weldments extending around full extents of said second open end edges and said second terminal end edges, said plurality of second TIG weldments located adjacent said second annular channel.

18. The pneumatically-operated magnetic separator as set forth in claim 1, wherein material of said plurality of tubes resides in said first and second bevel edges upon establishment of said plurality of first and second TIG weldments.

19. The pneumatically-operated magnetic separator as set forth in claim 1, further comprising an internal baffle body located within said main fluid passage, said internal baffle body diverting process fluid flow toward said plurality of tubes.

20. The pneumatically-operated magnetic separator as set forth in claim 17, further comprising an internal baffle body located within said main fluid passage, said internal baffle body diverting process fluid flow toward said plurality of tubes.

* * * * *